US010559437B1

(12) United States Patent
Chen et al.

(10) Patent No.: US 10,559,437 B1
(45) Date of Patent: Feb. 11, 2020

(54) MEMBRANE SWITCH DEVICE AND KEYBOARD DEVICE

(71) Applicant: Chicony Electronics Co., Ltd., New Taipei (TW)

(72) Inventors: Chia-Hsin Chen, New Taipei (TW); Mitsuo Horiuchi, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/285,558

(22) Filed: Feb. 26, 2019

Related U.S. Application Data

(60) Provisional application No. 62/724,656, filed on Aug. 30, 2018.

(30) Foreign Application Priority Data

Sep. 17, 2018 (TW) ..... 107132703 A

(51) Int. Cl.
*H01H 13/81* (2006.01)
*H01H 13/703* (2006.01)

(52) U.S. Cl.
CPC ..... *H01H 13/81* (2013.01); *H01H 13/703* (2013.01); *H01H 2207/026* (2013.01); *H01H 2227/036* (2013.01)

(58) Field of Classification Search
USPC ..... 361/749
See application file for complete search history.

(56) References Cited

U.S. PATENT DOCUMENTS

2012/0293240 A1* 11/2012 Tseng Tsai ..... H01H 13/79 327/517
2018/0082803 A1* 3/2018 Winter ..... H01H 13/705

FOREIGN PATENT DOCUMENTS

CN 101925254 A 12/2010
CN 201774737 U 3/2011

* cited by examiner

*Primary Examiner* — Andargie M Aychillhum
(74) *Attorney, Agent, or Firm* — Muncy, Geissler, Olds & Lowe, P.C.

(57) ABSTRACT

A membrane switch device includes first and second membrane layers, a spacing layer between the membrane layers, and a flexible printed circuit board. The first membrane layer includes a first surface and first conductive wires on the first surface and extending to a first wire area to form first contact pads. The second membrane layer includes a second surface and second conductive wires on the second surface and extending to a second wire area to form second contact pads. A wire-connecting end of the flexible printed circuit board is between the first membrane layer and the second membrane layer. A first protection layer of the flexible printed circuit board and the first contact pads are not overlapped with each other, and a second protection layer of the flexible printed circuit board and the second contact pads are not overlapped with each other.

21 Claims, 7 Drawing Sheets

MEMBRANE SWITCH DEVICE AND KEYBOARD DEVICE

CROSS-REFERENCES TO RELATED APPLICATIONS

This application claims the priority benefit of U.S. provisional application Ser. No. 62/724,656, filed on Aug. 30, 2018 and patent application Ser. No. 10/713,2703 filed in Taiwan, R.O.C. on Sep. 17, 2018. The entirety of the above-mentioned patent applications are hereby incorporated by references herein and made a part of the specification.

BACKGROUND

Technical Field

The instant disclosure relates to a switch device, in particular, to a membrane switch device and a keyboard device.

Related Art

In recent years, switch devices, due to their small volumes, thin thicknesses, and lightweights, are widely utilized in different electronic devices (e.g., keyboards), in response to the "thin and light" trend in manufacturing products. In general, a membrane switch device is connected to the system circuit board of an electronic device through a flexible printed circuit (FPC) board for the signal transmission between the switch device and the system circuit board.

As shown in FIG. 1, a sectional view of a membrane switch 1P known to the inventor(s) is illustrated. The membrane switch 1P includes an upper membrane 10P, a lower membrane 11P, a middle separation layer 12P, and a flexible printed circuit board 13P. The middle separation layer 12P is between the upper membrane 10P and the lower membrane 11P. A metal pattern 101P is printed on the lower surface of the upper membrane 10P, and a metal pattern 111P is printed on the upper surface of the lower membrane 11P. One end of the flexible printed circuit board 13P is inserted between the metal pattern 101P of the upper membrane 10P and the metal pattern 111P of the lower membrane 11P from one side of the membrane switch 1P. The inserted end of the flexible printed circuit board 13P has an upper pattern 131P, an upper covering layer 132P, a lower pattern 134P, and a lower covering layer 135P. The upper covering layer 132P covers a portion of the upper pattern 131P, and an upper connecting end 133P of the upper pattern 131P is exposed from the upper covering layer 132P for being electrically connected to the metal pattern 101P. The lower covering layer 135P covers a portion of the lower pattern 134P, and a lower connecting end 136P of the lower pattern 134P is exposed from the lower covering layer 135P for being electrically connected to the metal pattern 111P.

SUMMARY

However, since the metal pattern 101P and the upper covering layer 132P of the membrane switch 1P known to the inventor(s) are partially overlapped, a step is formed between the metal pattern 101P and the upper connecting end 133P (that is, the metal pattern 101P and the upper connecting end 133P are not at the same plane). Similarly, since the metal pattern 111P and the lower covering layer 135P are partially overlapped, a step is formed between the metal pattern 111P and the lower connecting end 136P (that is, the metal pattern 111P and the lower connecting end 136P are not at the same plane). As a result, the metal patterns 101*p*, 111P may suffer the stress generated on the upper covering layer 132P and the lower covering layer 135P and respectively detach from the upper connecting end 133P and the lower connecting end 136P, and air gaps are formed between the upper covering layer 132P and the upper connecting end 133P as well as between the lower covering layer 135P and the lower connecting end 136P. Consequently, the patterns of the membrane switch 1P may have a bad or poor electrical connection, and the membrane switch 1P may fail to receive signals or may send wrong signals.

In view of this, in one embodiment of the instant disclosure, a membrane switch device is provided. The membrane switch device comprises a first membrane layer, a second membrane layer, a spacing layer, and a flexible printed circuit board. The first membrane layer comprises a first surface, a first side edge, and a plurality of first conductive wires. The first surface has a first outlet area, and the first outlet area has a first no-wire area and a first wire area. The first conductive wires are disposed on the first surface and extending to the first wire area to form a plurality of first contact pads. The second membrane layer comprises a second surface, a second side edge, and a plurality of second conductive wires. The second surface has a second outlet area, and the second outlet area has a second no-wire area and a second wire area. The second conductive wires are disposed on the second surface and extending to the second wire area to form a plurality of second contact pads. The spacing layer is between the first membrane layer and the second membrane layer. The flexible printed circuit board comprises a wire-connecting end, a plurality of first electrical lines, a plurality of second electrical lines, a first protection layer, a second protection layer, a first connection surface, and a second connection surface opposite to the first connection surface. The first electrical lines are disposed on the first connection surface and extending to the wire-connecting end to form a plurality of first connecting terminals. The first protection layer covers the first electrical lines to expose the first connecting terminals. The second electrical lines are disposed on the second connection surface and extending to the wire-connecting end to form a plurality of second connecting terminals. The second protection layer covers the second electrical lines to expose the second connecting terminals. The wire-connecting end of the flexible printed circuit board is between the first outlet area of the first membrane layer and the second outlet area of the second membrane layer. The first connecting terminals are electrically connected to the first contact pads correspondingly. The second connecting terminals are electrically connected to the second contact pads correspondingly. The first protection layer and the first contact pads are not overlapped with each other, and the second protection layer and the second contact pads are not overlapped with each other.

In one embodiment of the instant disclosure, a membrane switch device is provided. The membrane switch device comprises a membrane layer and a flexible printed circuit board. The membrane layer comprises a surface, a side edge, and a plurality of conductive wires. The surface has an outlet area, and the outlet area has a no-wire area and a wire area. The conductive wires are disposed on the surface and extending to the wire area to form a plurality of contact pads. The flexible printed circuit board comprises a wire-connecting end, a plurality of electrical lines, a protection layer, and a connection surface. The electrical lines are disposed on the connection surface and extending to the wire-connecting end to form a plurality of connecting terminals. The protection layer covers the electrical lines to expose the connecting terminals. The wire-connecting end of the flexible printed circuit board is connected to the outlet area. The connecting terminals are electrically connected to the contact pads correspondingly. The protection layer and the contact pads are not overlapped with each other.

In one embodiment of the instant disclosure, a keyboard device is provided. The keyboard device comprises the membrane switch device according to the foregoing embodiments and a plurality of keys arranged on the membrane switch device.

As above, in the membrane switch device according to one or some embodiments of the instant disclosure, because the protection layer of the flexible printed circuit board is not overlapped with the contact pads on the wire area, the contact pads of is not detached from the connecting terminals due to the stress generated on the protection layer, and no air gap is formed between the contact pads and the connecting terminals. Therefore, the contact pads can have proper electrical connections with the connecting terminals, and the overall thickness of the membrane switch device can be further reduced.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 2:
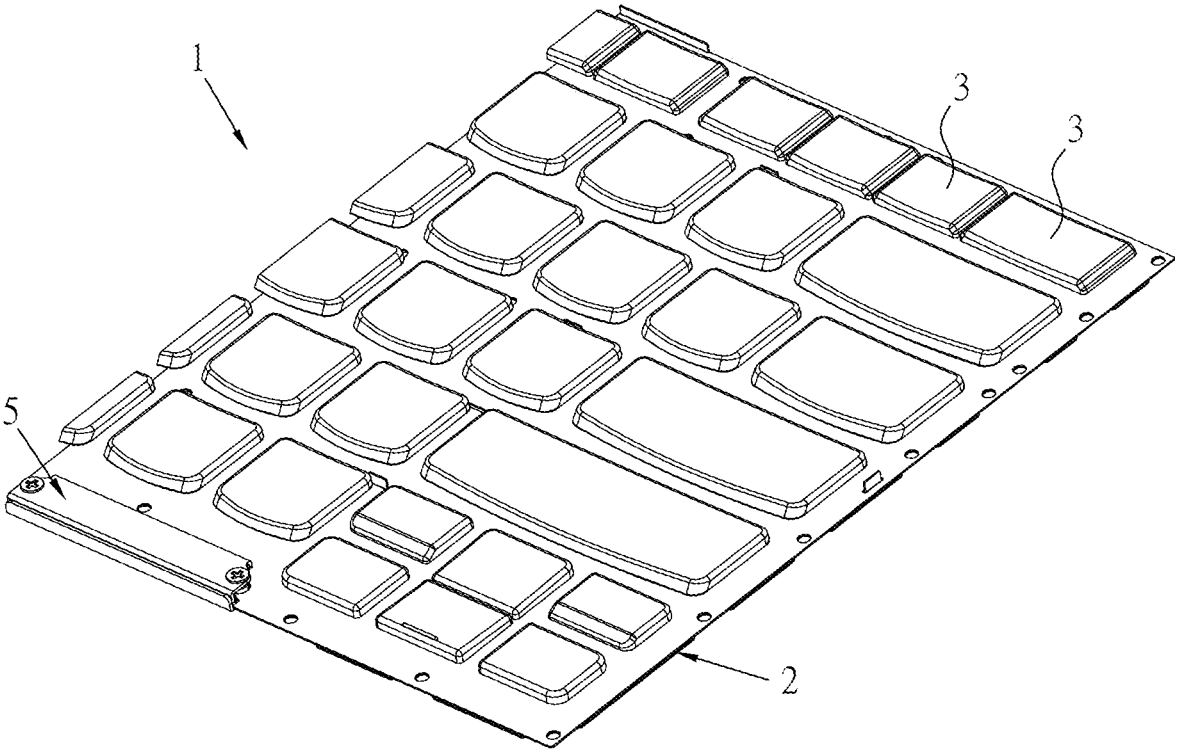
FIG. 2 illustrates a partial perspective view of a keyboard device according to an exemplary embodiment of the instant disclosure.
Figure 3:
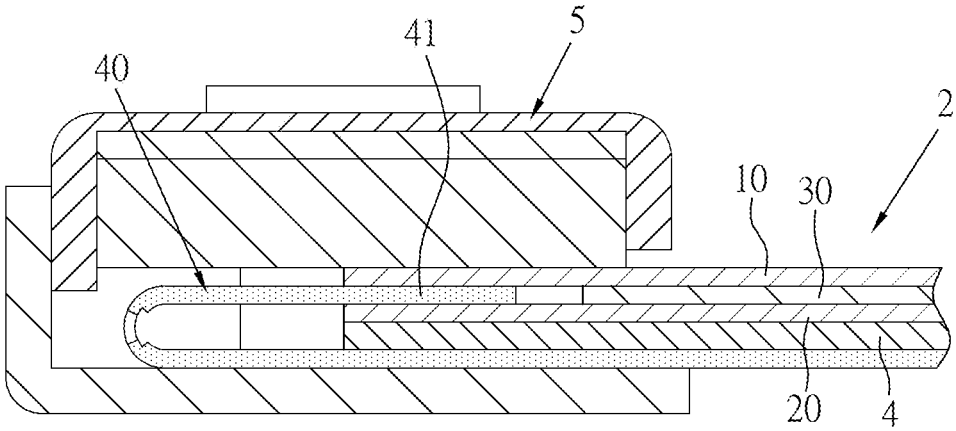
FIG. 3 illustrates a partial sectional view of the keyboard device of the exemplary embodiment.
Figure 4:
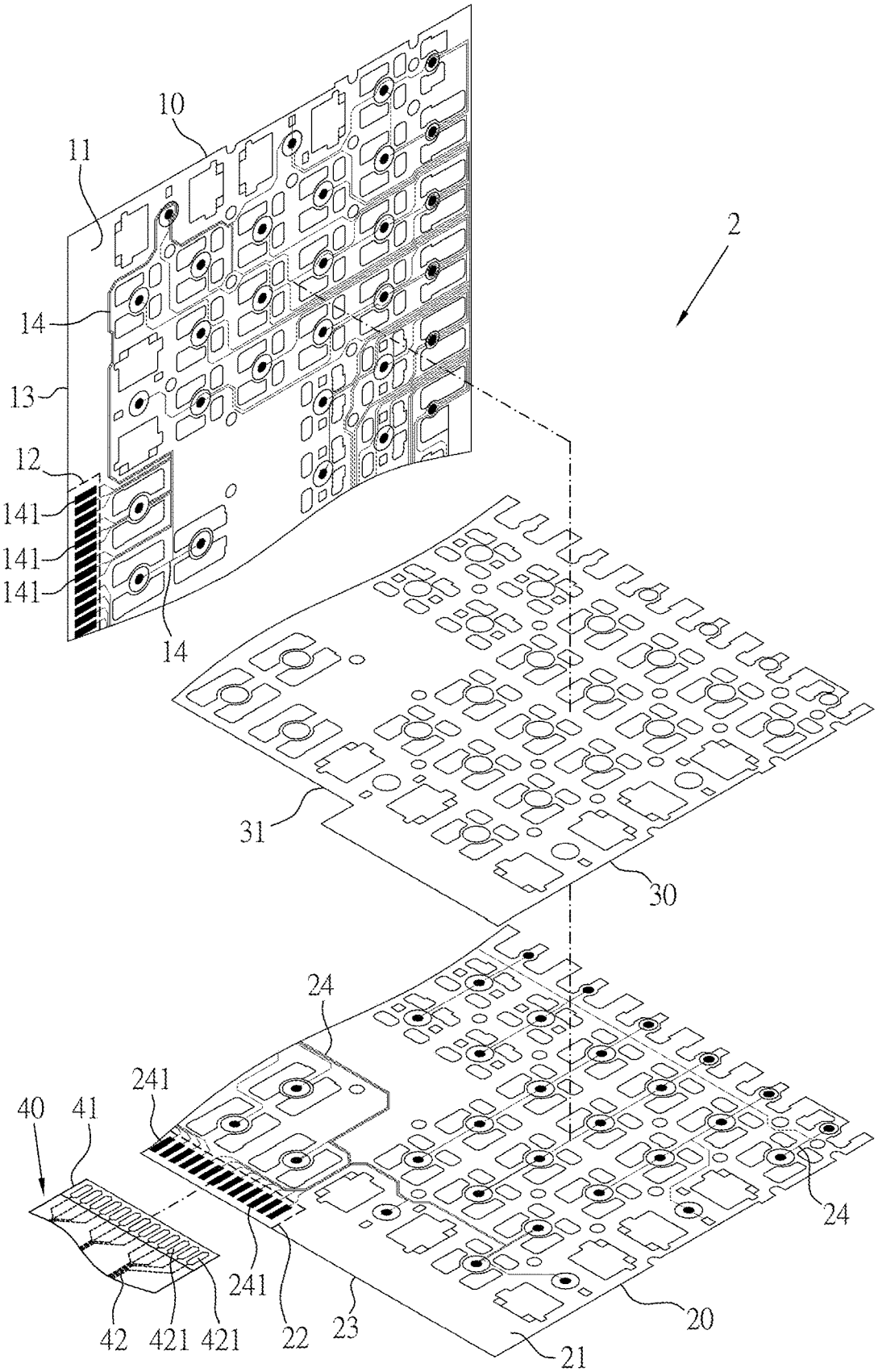
FIG. 4 illustrates a partial exploded view of a membrane switch device according to a first embodiment of the instant disclosure.
Figure 5:
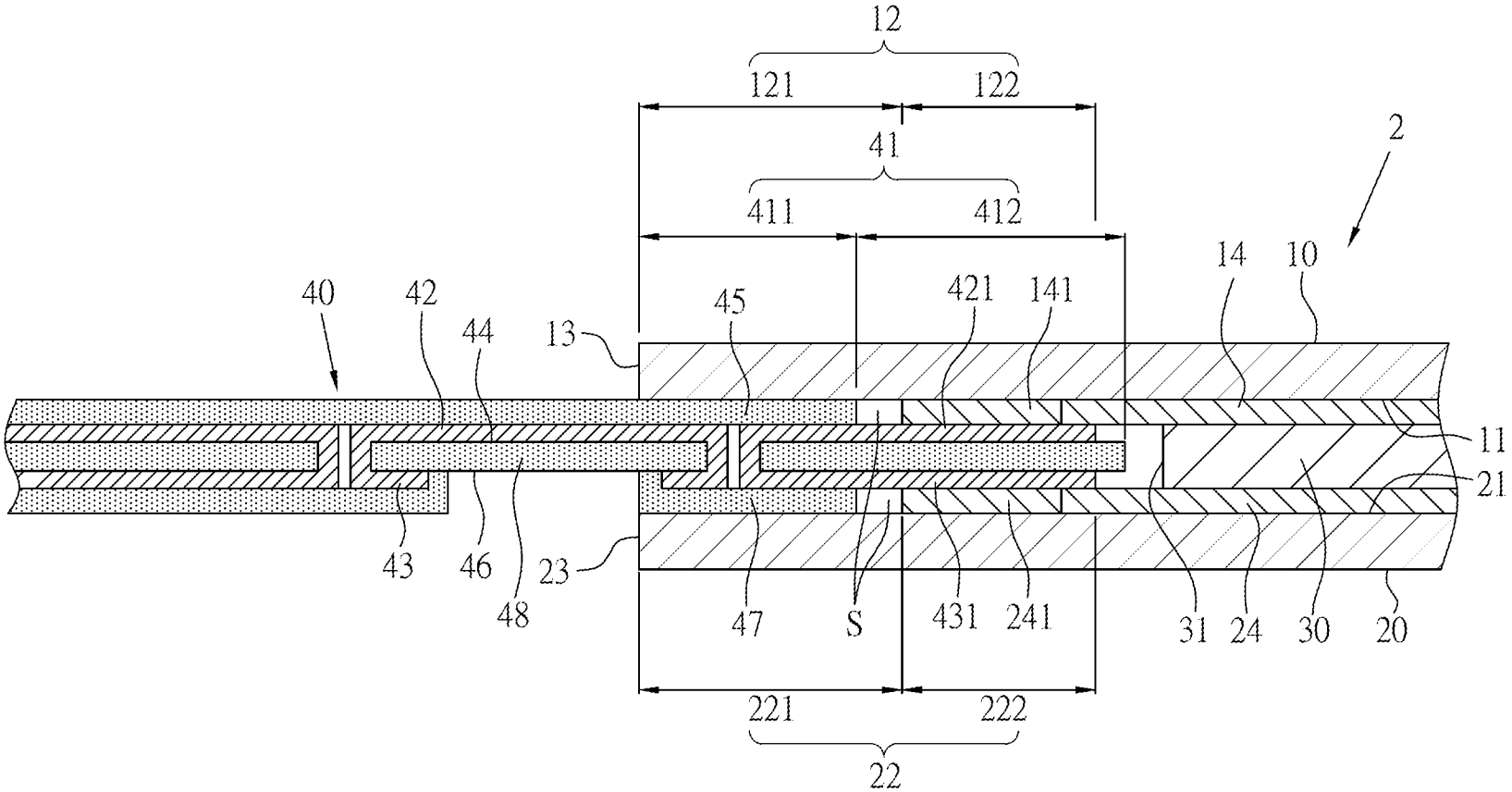
FIG. 5 illustrates a partial sectional view of the membrane switch device of the first embodiment.

FIG. 2 illustrates a partial perspective view of a keyboard device according to an exemplary embodiment of the instant disclosure. FIG. 3 illustrates a partial sectional view of the keyboard device of the exemplary embodiment. FIG. 4 illustrates a partial exploded view of a membrane switch device according to a first embodiment of the instant disclosure. FIG. 5 illustrates a partial sectional view of the membrane switch device of the first embodiment. As shown in FIGS. 2 and 3, in this embodiment, the keyboard device 1 is a computer keyboard, and the keyboard device 1 comprises a membrane switch device 2, a plurality of keys 3, and a base plate 4. The membrane switch device 2 is assembled on the base plate 4, and the keys 3 are pressably arranged on the membrane switch device 2. For example, a resilient member (not shown) may be between each of the keys 3 and the membrane switch device 2, and the resilient member may be an elastic member or an elastic pin. Therefore, when the key 3 is pressed, the key 3 is moved toward the membrane switch device 2 downwardly to trigger a signal and to compress the resilient member to store elastic force. Conversely, when the key 3 is released, the key 3 is moved upwardly to the original position of the key 3 by the elastic force stored in the resilient member. In other embodiments, the keyboard device 1 may be the key sets of other electronic devices, but embodiments are not limited thereto.

Figure 1:
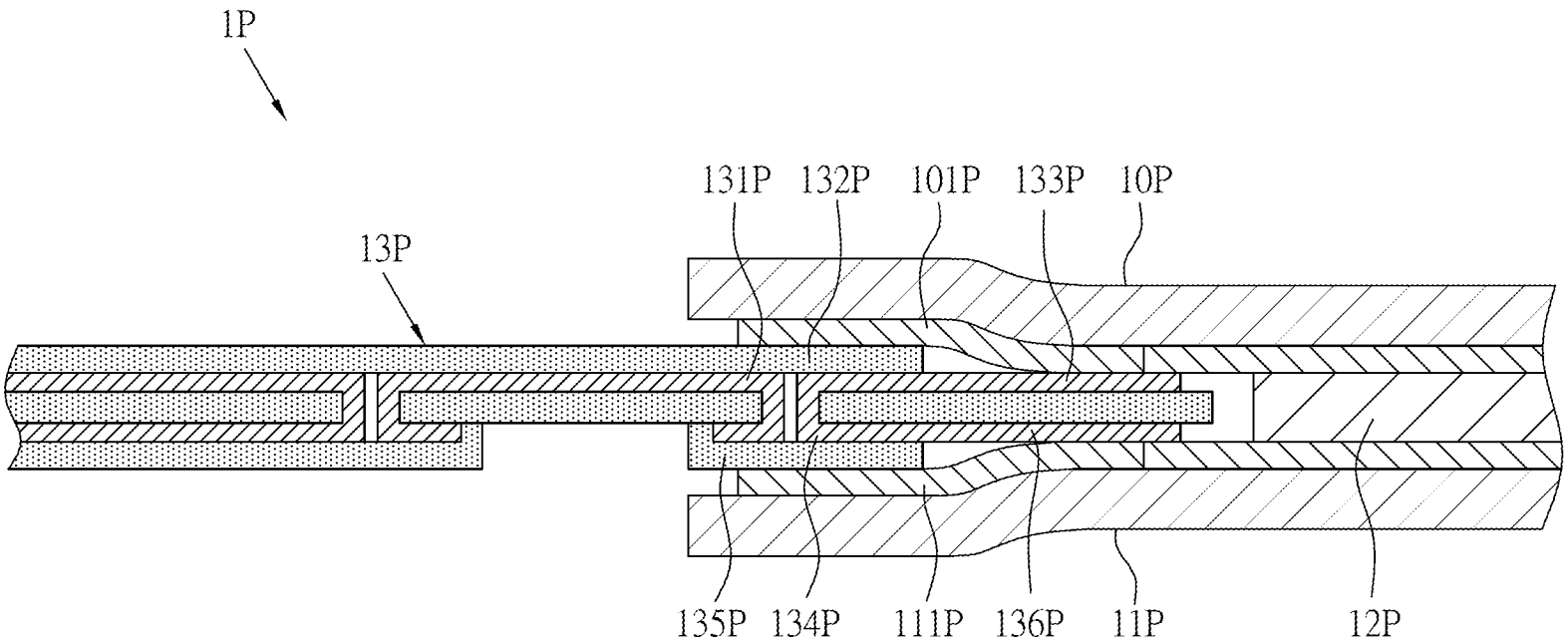
FIG.1 (PRIOR ART)
FIG. 1 illustrates a partial sectional view of a membrane switch known to the inventor(s)

As shown in FIGS. 4 and 5, the membrane switch device 2 comprises a first membrane layer 10, a second membrane layer 20, a spacing layer 30, and a flexible printed circuit (FPC) board 40. In this embodiment, the first membrane layer 10 is the top layer, the second membrane layer 20 is the bottom layer, and the spacing layer 30 is disposed between the first membrane layer 10 and the second membrane layer 20. For example, the spacing layer 30 may be attached between the first membrane layer 1 and the second membrane layer 20 via glues. However, in some embodiments, the upper/lower configuration of the first membrane layer 10 and the second membrane layer 20 of the membrane switch device 2 can be changed according to actual requirements. As shown in FIGS. 1 and 2, taking a membrane switch device 2 applied to the keyboard device 1 as an example, the first membrane layer 10 may be near the keys 3 of the keyboard device 1, and the second membrane layer 20 is relatively near the base plate 4 of the keyboard device 1. Alternately, in some embodiments, the first membrane layer 10 may be near the base plate 4 of the keyboard device 1, and the second membrane layer 20 is relatively near the keys 3 of the keyboard device 1, but embodiments are not limited thereto. In some embodiments, the first membrane layer 10, the second membrane layer 20, and the spacing layer 30 may be membranes made of polyimide (PI), polyethylene terephthalate (PET), polycarbonate (PC), or other materials.

Please refer to FIGS. 4 and 5. The first membrane layer 10 has a first surface 11 and a first side edge 13, and a plurality of first conductive wires 14 are disposed on the first membrane layer 10. In this embodiment, the first surface 11 is the lower surface of the first membrane layer 10 (while in the case that the first membrane layer 10 is the bottom layer, the first surface 11 is the upper surface of the first membrane layer 10). Furthermore, the first surface 11 has a first outlet area 12 (wire-outlet area), and the first outlet area 12 is a portion of the first surface 11. The first outlet area 12 has a first no-wire area 121 and a first wire area 122. The first no-wire area 121 is adjacently connected to the first side edge 13, and a distance between the first wire area 122 and the first side edge 13 is greater than a distance between the first no-wire area 121 and the first side edge 13. In other words, the first outlet area 12 can be further divided into two areas (i.e., the first no-wire area 121 and the first wire area 122), and the first no-wire area 121 is closer to the first side edge 13, with respect to the first wire area 122 and the first side edge 13. That is, the distance between the first no-wire area 121 and the first side edge 13 is less than the distance between the first wire area 122 and the first side edge 13.

As shown in FIGS. 4 and 5, the first conductive wires 14 are disposed on the first surface 11. For example, the first conductive wires 14 may be metal patterns and may be formed on the first surface 11 by printing or etching. The first conductive wires 14 may be copper patterns, silver paste patterns, or other metal patterns. However, the first conductive wires 14 are not limited to metal patterns; the first conductive wires 14 may be made of other conductive materials. Furthermore, one ends of the first conductive wires 14 are extending to the first wire area 122 to form a plurality of first contact pads 141. That is, the first conductive wires 14 are not extending to the first no-wire area 121 of the first outlet area 12, so that the surface of the first no-wire area 121 has no wire. In some embodiments, the first contact pads 141 may be parts of the patterns at the end portions of the first conductive wires 14, or the first contact pads 141 may be additional conductive pads. For example, the first conductive wires 14 may be copper patterns, and the first contact pads 141 are silver-paste conductive pads printed on the first wire area 122 and connected to the end portions of the first conductive wires 14. Further, the electric conductivity of the first contact pad 141 may be greater than the electric conductivity of the first conductive wire 14 for improving the electrical conductivity of the first contact pad 141.

As shown in FIGS. 4 and 5, the second membrane layer 20 has a second surface 21 and a second side edge 23, and a plurality of second conductive wires 24 are disposed on the second membrane layer 20. The second surface 21 faces the first surface 11 of the first membrane layer 10. The second side edge 23 and the first side edge 13 of the first membrane layer 10 are at the same side of the membrane switch device 2. Furthermore, the second surface 21 has a second outlet area 22 corresponding to the first outlet area 12. The second outlet area 22 is a portion of the second surface 21, and the second outlet area 22 has a second no-wire area 221 and a second wire area 222. The second no-wire area 221 is adjacently connected to the second side edge 23, and a distance between the second wire area 222 and the second side edge 23 is longer than a distance between the second no-wire area 221 and the second side edge 23. In other words, the second outlet area 22 is also divided into two areas (i.e., the second no-wire area 221 and the second wire area 222), and the second no-wire area 221 is closer to the second side edge 23, with respect to the second wire area 222 and the second side edge 23 (that is, the distance between the second no-wire area 221 and the second side edge 23 is less than the distance between the second wire area 222 and the second side edge 23). The second no-wire area 221 corresponds to the first no-wire area 121, and the second wire area 222 corresponds to the first wire area 122.

As shown in FIGS. 4 and 5, the second conductive wires 24 are on the second surface 21. For example, the second conductive wires 24 may be metal patterns, and may be formed on the second surface 21 by printing or etching. Furthermore, one ends of the second conductive wires 24 are further extending to the second wire area 222 of the second outlet area 22 to form a plurality of second contact pads 241. In other words, the second conductive wires 24 are not extending to the second no-wire area 221 of the second outlet area 22, so that the surface of the second no-wire area 221 has no wire. In some embodiments, the second contact pads 241 may be parts of the patterns at the end portions of the second conductive wires 24, or the second contact pads 241 may be additional conductive pads. For example, the second conductive wires 24 may be copper patterns, and the second contact pads 241 are silver-paste conductive pads printed on the second wire area 222 and connected to the end portions of the second conductive wires 24. Further, the electric conductivity of the second contact pad 241 may be greater than the electric conductivity of the second conductive wire 24 for improving the electric conductivity of the second contact pad 241.

As shown in FIGS. 4 and 5, the spacing layer 30 between the first membrane layer 10 and the second membrane layer 20 is not extending to a portion between the first outlet area 12 and the second outlet area 22. For example, in this embodiment, the spacing layer 30 has an escape hole 31 corresponding to the first outlet area 12 and the second outlet area 22, so that the escape hole 31 allows the communication between the first outlet area 12 and the second outlet area 22 and the flexible printed circuit board 40 can be inserted into the escape hole 31 and not blocked by the spacing layer 30 for receiving external signals or for sending signals externally. For example, as shown in FIGS. 1 and 2, the flexible printed circuit board 40 may be connected to a connector of a computer motherboard (not shown), so that a corresponding signal or signals can be generated when the key 3 is pressed.

As shown in FIGS. 4 and 5, the flexible printed circuit board 40 comprises wire-connecting end 41, a plurality of first electrical lines 42, a plurality of second electrical lines 43, a first connection surface 44, and a second connection surface 46 opposite to the first connection surface 44. The wire-connecting end 41 is one end of the flexible printed circuit board 40, and the wire-connecting end 41 is inserted between the first outlet area 12 of the first membrane layer 10 and the second outlet area 22 of the second membrane layer 20. Furthermore, the wire-connecting end 41 has a cover area 411 and an expose area 412. That is, the wire-connecting end 41 is divided into two areas (i.e., the cover area 411 and the expose area 412), and the expose area 412 is closer to the edge portion of the flexible printed circuit board 40, with respect to the cover area 411 and the edge portion (that is, the distance between the expose area 412 and the edge portion of the flexible printed circuit board 40 is less than the distance between the cover area 411 and the edge portion of the flexible printed circuit board 40).

As shown in FIGS. 4 and 5, in this embodiment, the flexible printed circuit board 40 has a soft substrate 48. The soft substrate 48 may be a membrane made of polyimide (PI), polyethylene terephthalate (PET), polycarbonate (PC), or other materials to have flexibility. The first connection surface 44 and the second connection surface 46 are two opposite surfaces of the soft substrate 48. The first electrical lines 42 are on the first connection surface 44 and extending to the wire-connecting end 41 to form a plurality of first connecting terminals 421. The second electrical lines 43 are on the second connection surface 46 and extending to the wire-connecting end 41 to form a plurality of second connecting terminals 431. The first electrical lines 42 and the second electrical lines 43 may be metal patterns, and may be formed by printing or etching. The first connecting terminals 421 may be parts of the patterns at the end portions of the first electrical lines 42, or the first connecting terminals 421 may be additional conductive pads. Similarly, the second connecting terminals 431 may be parts of the patterns at the end portions of the second electrical lines 43, or the second connecting terminals 43 may be additional conductive pads.

As shown in FIGS. 4 and 5, a first protection layer 45 is further provided on the first connection surface 44 of the flexible printed circuit board 40. The first protection layer 45 may be a flexible membrane made of plastics. The first protection layer 45 covers the first electrical lines 42 and is only extending to the cover area 411 to expose the expose area 412 and the first connecting terminals 421 (that is, the first connecting terminals 421 are not covered by the first protection layer 45). Therefore, portions of the first electrical lines 42 exposed from the first membrane layer 10 and the second membrane layer 20 can be protected by the first protection layer 45 to prevent from oxidation or sulfurization under air exposure. Conversely, a second protection layer 47 is further provided on the second connection surface 46 of the flexible printed circuit board 40. The second protection layer 47 may be a flexible membrane made of plastics. The second protection layer 47 covers the second electrical lines 43 and is only extending to the cover area 411 to expose the expose area 412 and the second connecting terminals 431 (that is, the second connecting terminals 431 are not covered by the second protection layer 47). Therefore, portions of the second electrical lines 43 exposed from the first membrane layer 10 and the second membrane layer 20 can be protected by the second protection layer 47 to prevent from oxidation or sulfurization under air exposure.

As shown in FIGS. 4 and 5, the first connecting terminals 421 at the expose area 412 of the wire-connecting end 41 are electrically connected to the first contact pads 141 at the first wire area 122 correspondingly, and the first protection layer 45 at the cover area 411 and the first contact pads 141 at the first wire area 122 are not overlapped with each other. Similarly, the second connecting terminals 431 at the expose area 412 of the wire-connecting end 41 are electrically connected to the second contact pads 241 at the second wire area 22 correspondingly, and the second protection layer 47 at the cover area 411 and the second contact pads 241 at the second wire area 22 are not overlapped with each other. In detail, as shown in FIG. 5, the first no-wire area 121 of the first membrane layer 10 is stacked on the first protection layer 45 at the cover area 411 of the wire-connecting end 41, and each of the first contact pads 141 at the first wire area 122 of the first membrane layer 10 is stacked on the corresponding first connecting terminal 421 at the expose area 412 of the wire-connecting end 41 for electrical connection. Therefore, the first protection layer 45 and the first contact pads 141 are at the same height, and the first protection layer 45 and the first contact pads 141 are end-to-end mated with each other (that is, the end portion of the first protection layer 45 corresponds to end portions of the first contact pads 141). Similarly, the second no-wire area 221 of the second membrane layer 20 is stacked on the second protection layer 47 at the cover area 411 of the wire-connecting end 41, and each of the second contact pads 241 at the second wire area 222 of the second membrane layer 20 is stacked on the corresponding second connecting terminal 431 at the expose area 412 of the wire-connecting end 41 for electrical connection. Therefore, the second protection layer 47 and the second contact pads 241 are at the same height, and the second protection layer 47 and the second contact pads 241 of the second membrane layer 20 are end-to-end mated with each other (that is, the end portion of the second protection layer 47 corresponds to end portions of the second contact pads 241).

Accordingly, please refer to FIGS. 1 and 5. As compared with the membrane switch 1P known to the inventor(s), in the membrane switch device 1 in one or some embodiments of the instant disclosure, the first contact pads 141 of the first membrane layer 10 and the second contact pads 241 of the second membrane layer 20 are not detached from the first connecting terminals 421 and the second connecting terminals 431 at the expose area 412 due to the stress generated on the first protection layer 45 and the second protection layer 47, and no air gaps are formed between the first contact pads 141 and the first connecting terminals 421 as well as the second contact pads 241 and the second connecting terminals 431. Therefore, the first contact pads 141 and the second contact pads 241 can respectively have proper electrical connections with the first connecting terminals 421 and the second connecting terminals 431, and the overall thickness of the membrane switch device 1 can be further reduced.

Figure 9:
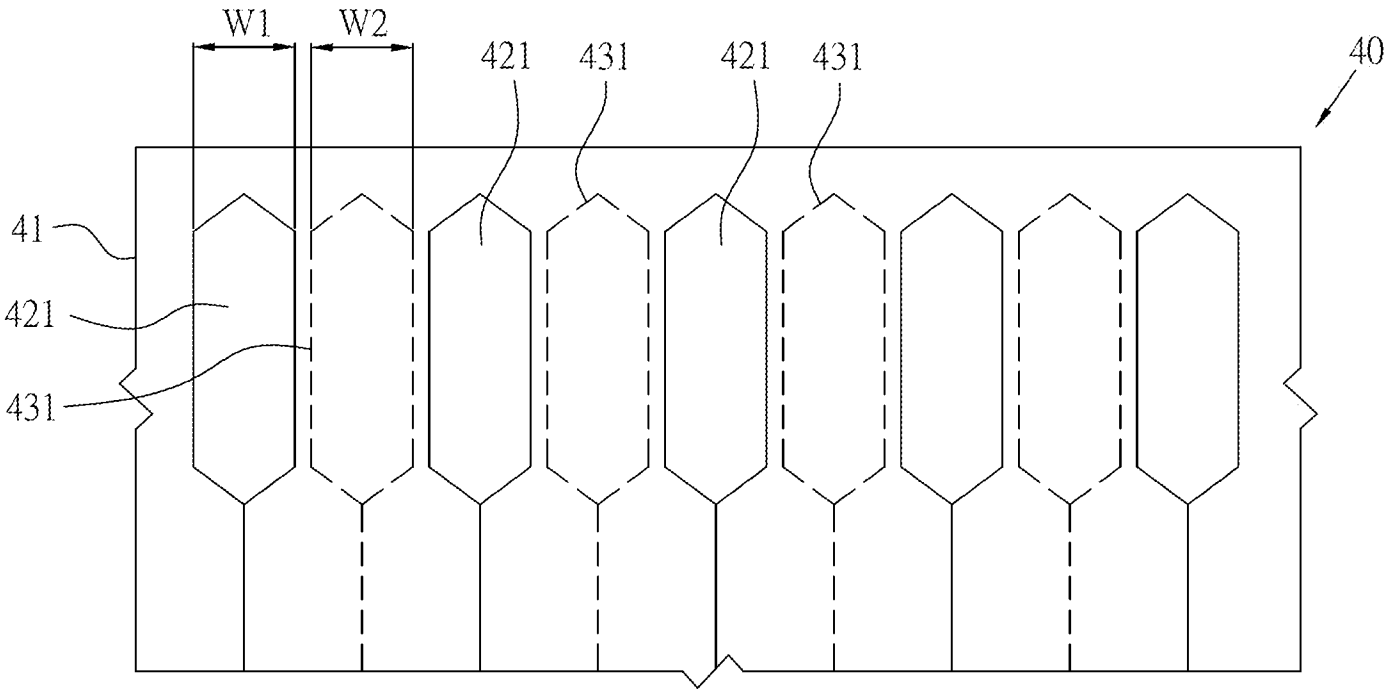
FIG. 9 illustrates a partial plan view of a flexible printed circuit board according to an exemplary embodiment of the instant disclosure.

As shown in FIG. 4, in one embodiment, a width of each of the first connecting terminals 421 is greater than a width of the corresponding first contact pad 141, and a width of each of the second connecting terminals 431 is greater than a width of the corresponding second contact pad 241. Therefore, during stacking the first contact pads 141 and the second contact pads 241 on the first connecting terminals 421 and the second connecting terminals 431 respectively, a small offset deviation is allowed. As shown in FIG. 9, in one embodiment, the width W1 of each of the first connecting terminals 421 may be a distance between the two opposite longer sides of the first connecting terminal 421, and the width W2 of each of the second connecting terminals 431 may be a distance between the two opposite longer sides of the second connecting terminal 431. Further, the width of each of the first contact pads 141 may be a distance between the longer sides of the first contact pad 141, and the width of each of the second contact pads 241 may be a distance between the longer sides of the second contact pad 241 (not shown in the figure).

Please refer to FIGS. 2, 3, and 5. In one embodiment, after the wire-connecting end 41 of the flexible printed circuit board 40 is inserted between the first membrane layer 10 and the second membrane layer 20 and is electrically connected to the first conductive wires 14 and the second conductive wires 24, the flexible printed circuit board 40 can be bent and stacked below the base plate 4, and then the first membrane layer 10, the wire-connecting end 41, the second membrane layer 20, the base plate 4, and parts of the flexible printed circuit board 40 stacked below the base plate 4 are firmly fastened with each other by the fastening member 5 (for example, by clamping, locking, or other ways). Therefore, the first contact pads 141 can be electrically connected to the first connecting terminals 421, and the second contact pads 241 can be electrically connected to the second connecting terminals 431 in a firmly manner.

Further, as shown in FIG. 5, in one embodiment, a tolerance distance S is between the end portion of the first protection layer 45 and the end portions of the first contact pads 141, and a tolerance distance S is between the end portion of the second protection layer 47 and the end portions of the second contact pads 241. Accordingly, the manufacturing tolerances between the components in the membrane switch device 2 (e.g., the first membrane layer 10, the second membrane layer 20, the spacing layer 30, and the flexible printed circuit board 40) do not result the overlapping between the first protection layer 45 and the first contact pads 141 or the overlapping between the second protection layer 47 and the second contact pads 241, but embodiments are not limited thereto. In another embodiment, as shown in FIG. 6, the end portion of the first protection layer 45 of the membrane switch device 2A is connected to the end portions of the first contact pads 141, and the end portion of the second protection layer 47 of the membrane switch device 2A is connected to the end portions of the second contact pads 241.

Figure 6:
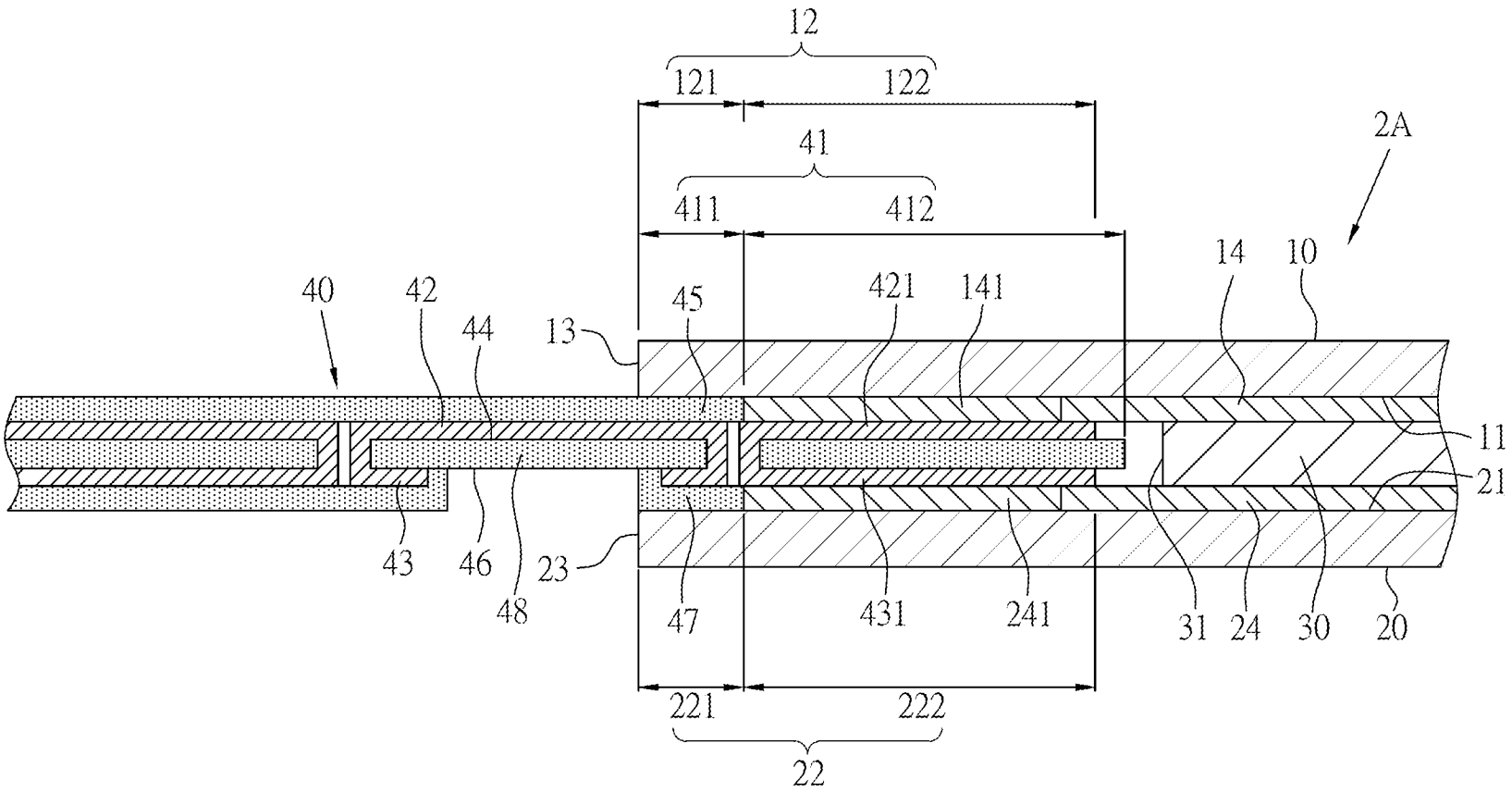
FIG. 6 illustrates a partial sectional view of a membrane switch device according to a second embodiment of the instant disclosure.

Further, as shown in FIG. 6, in the membrane switch device 2A of this embodiment, an area of the cover area 411 of the flexible printed circuit board 40 is less than an area of the expose area 412. In this embodiment, the cover area 411 is the area of the wire-connecting end 41 between the first side edge 13 and the edge of the first protection layer 45, and the expose area 412 is the area of the wire-connecting end 41 between the edge of the first protection layer 45 and the edge of the soft substrate 48. Alternatively, the cover area 411 is the area of the wire-connecting end 41 between the second side edge 23 and the edge of the second protection layer 47, and the expose area 412 is the area of the wire-connecting end 41 between the edge of the second protection layer 47 and the edge of the soft substrate 48. Accordingly, the exposed length of the first connecting terminals 421 and the exposed length of the second connecting terminals 431 on the expose area 412 can be lengthened to increase the electrical contact area for a better electrical connection.

Figure 7:
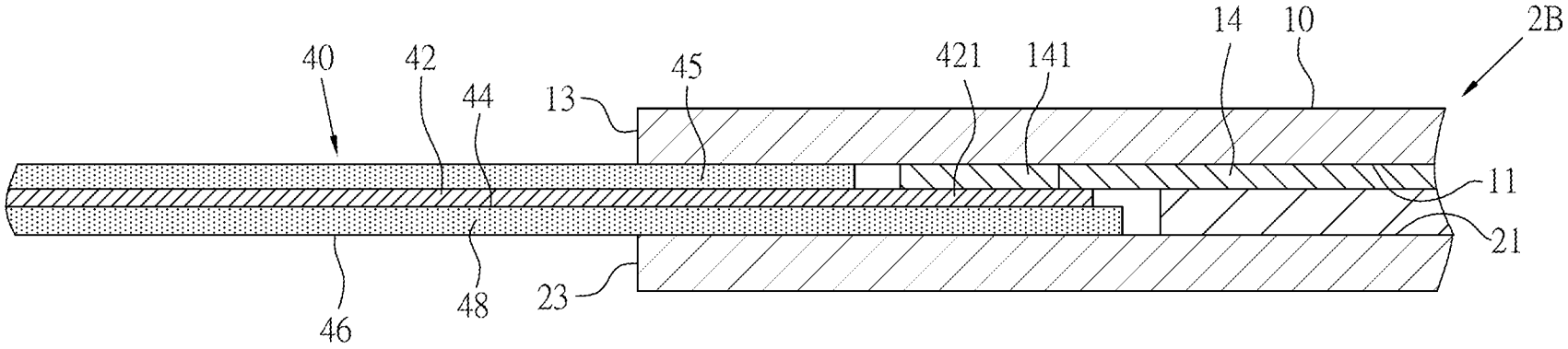
FIG. 7 illustrates a partial sectional view of a membrane switch device according to a third embodiment of the instant disclosure.
Figure 8:
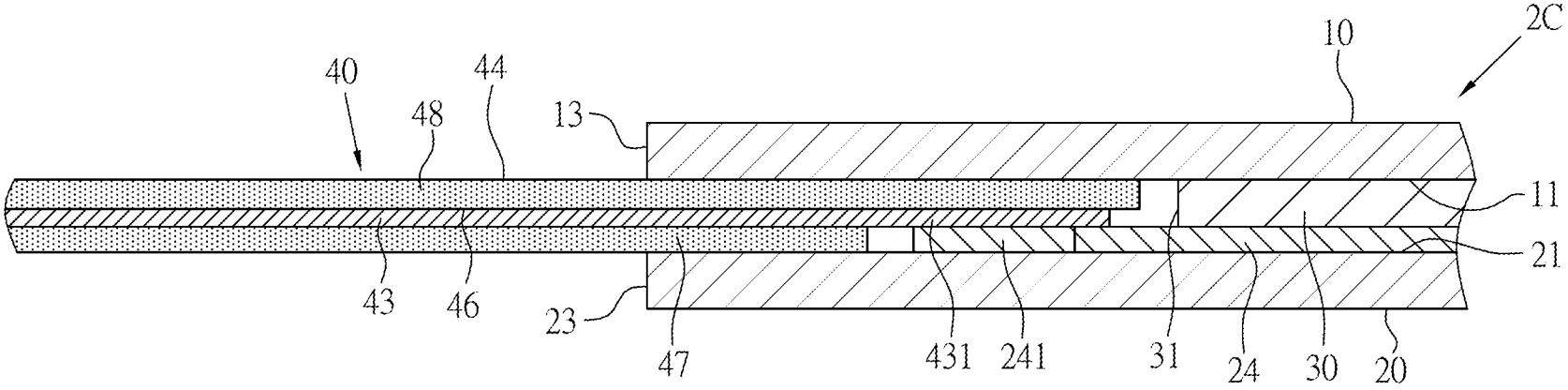
FIG. 8 illustrates a partial sectional view of a membrane switch device according to a fourth embodiment of the instant disclosure.

In some embodiments, the membrane switch device 2 may have patterns only on the first membrane layer 10 or on the second membrane layer 20. As shown in FIG. 7, in the membrane switch device 2B of this embodiment, a plurality of first conductive wires 14 is on the first surface 11 of the first membrane layer 10, and the second surface 21 of the second membrane layer 20 is devoid of wires. Further, a first protection layer 45, a plurality of first electrical lines 42, and a plurality of first connecting terminals 421 are on the first connection surface 44 of the flexible printed circuit board 40. Alternatively, as shown in FIG. 8, in the membrane switch device 2C of this embodiment, a plurality of second conductive wires 24 is on the second surface 21 of the second membrane layer 20, and the first surface 11 of the first membrane layer 10 is devoid of wires. Further, a second protection layer 47, a plurality of second electrical lines 43, and a plurality of second connecting terminals 431 are on the second connection surface 46 of the flexible printed circuit board 40.

As shown in FIGS. 5 and 9, in one embodiment, the first connecting terminals 421 on the first connection surface 44 and the second connecting terminals 431 on the second connection surface 46 may be alternately aligned on the flexible printed circuit board 40. In other words, as shown in FIG. 9, from left to right, the configuration is, the first connection terminal 421 on the first connection surface 44, the second connection terminal 431 on the second connection surface 46, the first connection terminal 421 on the first connection surface 44, the second connection terminal 431 on the second connection surface 46, and so on. Therefore, the stacked thickness of the first membrane layer 10, the second membrane layer 20, and the flexible printed circuit board 40 can be reduced, so that the overall thickness of the membrane switch device 2 can be further reduced.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A membrane switch device, comprising:

a first membrane layer comprising a first surface, a first side edge, and a plurality of first conductive wires, wherein the first surface has a first outlet area, the first outlet area has a first no-wire area and a first wire area, the first conductive wires are on the first surface and extending to the first wire area to form a plurality of first contact pads;

a second membrane layer comprising a second surface, a second side edge, and a plurality of second conductive wires, wherein the second surface has a second outlet area, the second outlet area has a second no-wire area and a second wire area, the second conductive wires are on the second surface and extending to the second wire area to form a plurality of second contact pads;

a spacing layer between the first membrane layer and the second membrane layer; and a flexible printed circuit board comprising a wire-connecting end, a plurality of first electrical lines, a plurality of second electrical lines, a first protection layer, a second protection layer, a first connection surface, and a second connection surface opposite to the first connection surface, wherein the first electrical lines are on the first connection surface and extending to the wire-connecting end to form a plurality of first connecting terminals, the first protection layer covers the first electrical lines to expose the first connecting terminals, the second electrical lines are on the second connection surface and extending to the wire-connecting end to form a plurality of second connecting terminals, the second protection layer covers the second electrical lines to expose the second connecting terminals;

wherein the wire-connecting end of the flexible printed circuit board is between the first outlet area of the first membrane layer and the second outlet area of the second membrane layer, the first connecting terminals are electrically connected to the first contact pads, correspondingly, the second connecting terminals are electrically connected to the second contact pads, correspondingly;

wherein the first protection layer and the first contact pads are not overlapped with each other, and the second protection layer and the second contact pads are not overlapped with each other.

2. The membrane switch device according to claim 1, wherein the first protection layer and the first contact pads are end-to-end mated with each other, and the second protection layer and the second contact pads are end-to-end mated with each other.

3. The membrane switch device according to claim 1, wherein the first no-wire area is adjacently connected to the first side edge, and a distance between the first wire area and the first side edge is greater than a distance between the first no-wire area and the first side edge.

4. The membrane switch device according to claim 3, wherein the spacing layer is not extending to a portion between the first outlet area and the second outlet area.

5. The membrane switch device according to claim 4, wherein the second outlet area corresponds to the first outlet area.

6. The membrane switch device according to claim 1, wherein a tolerance distance is between the first protection layer and the first contact pads.

7. The membrane switch device according to claim 1, wherein the first connecting terminals and the second connecting terminals are alternately aligned on the flexible printed circuit board.

8. The membrane switch device according to claim 1, wherein a width of each of the first connecting terminals is greater than a width of the corresponding contact pad.

9. The membrane switch device according to claim 1, wherein the wire-connecting end has a cover area and an expose area, the first protection layer covers the first electrical lines and is extending only to the cover area to expose the expose area and the first connecting terminals, the second protection layer covers the second electrical lines and is extending only to the cover area to expose the expose area and the second connecting terminals, and an area of the cover area is less than an area of the expose area.

10. A membrane switch device, comprising:

a membrane layer comprising a surface, a side edge, and a plurality of conductive wires, wherein the surface has an outlet area, the outlet area has a no-wire area and a wire area, the conductive wires are on the surface and extending to the wire area to form a plurality of contact pads; and a flexible printed circuit board comprising a wire-connecting end, a plurality of electrical lines, a protection layer, and a connection surface, wherein the electrical lines are on the connection surface and extending to the wire-connecting end to form a plurality of connecting terminals, the protection layer covers the electrical lines to expose the connecting terminals;

wherein the wire-connecting end of the flexible printed circuit board is connected to the outlet area, the connecting terminals are electrically connected to the contact pads, correspondingly, and the protection layer and the contact pads are not overlapped with each other.

11. The membrane switch device according to claim 10, wherein the protection layer and the contact pads are end-to-end mated with each other.

12. The membrane switch device according to claim 10, wherein the no-wire area is adjacently connected to the side edge, and a distance between the wire area and the side edge is greater than a distance between the no-wire area and the side edge.

13. The membrane switch device according to claim 10, wherein a tolerance distance is between the protection layer and the contact pads.

14. The membrane switch device according to claim 10, wherein a width of each of the connecting terminals is greater than a width of the corresponding contact pad.

15. The membrane switch device according to claim 10, wherein the wire-connecting end has a cover area and an expose area, the protection layer covers the electrical lines and is extending only to the cover area to expose the expose area and the connecting terminals, and an area of the cover area is less than an area of the expose area.

16. A keyboard device, comprising:

the membrane switch device according to claim 10; and a plurality of keys arranged on the membrane switch device.

17. The keyboard device according to claim 16, wherein the protection layer and the contact pads are end-to-end mated with each other.

18. The keyboard device according to claim 16, wherein the no-wire area is adjacently connected to the side edge, and a distance between the wire area and the side edge is greater than a distance between the no-wire area and the side edge.

19. The keyboard device according to claim 16, wherein a tolerance distance is between the protection layer and the contact pads.

20. The keyboard device according to claim 16, wherein a width of each of the connecting terminals is greater than a width of the corresponding contact pad.

21. The keyboard device according to claim 16, wherein the wire-connecting end has a cover area and an expose area, the protection layer covers the electrical lines and is extending only to the cover area to expose the expose area and the connecting terminals, and an area of the cover area is less than an area of the expose area.

* * * * *